United States Patent [19]

Overkott

[11] 3,980,506

[45] Sept. 14, 1976

[54] PROCESS FOR MANUFACTURING HIGHLY WEAR-RESISTANT, UNDISTORTED, AXIALLY SYMMETRICAL PARTS

[75] Inventor: Franz Josef Overkott, Gevelsberg, Germany

[73] Assignee: Carl Ullrich Peddinghaus, Wuppertal-Barmen, Germany

[22] Filed: Jan. 31, 1974

[21] Appl. No.: 438,415

[30] Foreign Application Priority Data

Jan. 31, 1973 Germany ..... 2304557

[52] U.S. Cl. ..... 148/16.5; 72/46; 72/84; 148/16.6; 148/131

[51] Int. Cl.[2] ..... C21D 1/48

[58] Field of Search ..... 148/12, 12.4, 16.5, 148/16.6, 11.5, 131; 72/46, 80, 84, 94

[56] References Cited

UNITED STATES PATENTS

| | | | |
|---|---|---|---|
| 2,304,666 | 12/1942 | Sturges | 148/12.1 |
| 2,390,417 | 12/1945 | Bramberry | 148/12.1 |
| 2,760,924 | 8/1956 | Troendly | 148/12.1 X |
| 3,321,338 | 5/1967 | Coubet | 148/12.1 X |
| 3,385,739 | 5/1968 | Danis | 148/16.5 X |
| 3,398,443 | 8/1968 | Coubet | 148/12.1 X |
| 3,535,169 | 10/1970 | Coubet | 148/12.1 X |

*Primary Examiner*—Walter R. Satterfield
*Attorney, Agent, or Firm*—Olson, Trexler, Wolters, Bushnell & Fosse, Ltd.

[57] ABSTRACT

A process for manufacturing highly wear-resistant, undistorted, axially symmetrical parts formed of a hardenable metal wherein the parts are subjected, in succession and whilst being rotated, to a surface pressure polishing process and to a surface hardening process without any further treatment.

4 Claims, No Drawings

PROCESS FOR MANUFACTURING HIGHLY WEAR-RESISTANT, UNDISTORTED, AXIALLY SYMMETRICAL PARTS

The invention relates to a process for manufacturing highly wear-resistant, undistorted, axially symmetrical parts of a hardenable metal, especially parts formed from steel bars with a fine finish.

Parts of this kind are often used as machine components and the way in which they are manufactured must obviously be governed by their working requirements. This applies particularly to piston rods which extend sealingly through the end wall of an associated cylinder. Such rods not only need to have a particularly good finish but they must be particularly straight and undistorted. The surface of such a piston rod must also be very hard, so that progressive wear in the course of a long working life does not lead to a badly sealed cylinder. Further, while the surface must be very smooth the bar itself must be straight because bends in the bar which can occur due to distortion during hardening would make it unsuitable for many applications and especially for use as a piston rod.

For this reason parts of the kind mentioned are usually subjected to surface treatment which affect the material of the parts a short distance down from the surface thereof. Surface treatments of this type may involve structural transformations or the penetration into the material of chemical elements such as carbon and nitrogen, so that the volume can increase and thus the surface layers can be stretched and strained, which can lead to distortion. Bars which are distorted in this way must then be straightened, and to do this straightening tools grip the surface and leave marks. Thus a polishing process is then necessary, and in many cases galvanic treatment, particularly chromium plating, is then undertaken. All these processes are, however, relatively expensive.

The object of the present invention is to provide an improved manufacturing process for producing parts as above-described which is considerably cheaper than hitherto known processes.

In accordance with the invention there is provided a process for manufacturing highly wear-resistant, undistorted, axially symmetrical parts of a hardenable metal characterised in that the parts are subjected in succession to a surface pressure polishing process and to a surface hardening process without any further treatment, the parts being rotated during said pressure polishing and surface hardening processes.

The above-defined process makes use of processes of surface treatment which are individually known in themselves. However, the novel combination and sequence of the two processes means surprisingly that distortion of parts so treated can be avoided, and that, after the hardening process, the parts have such a good surface finish that they can be used immediately, in particular as piston rods. Thus they do not need to be straightened or subjected to galvanic treatment or finally polished again. Precisely those processes which are most expensive are not used, as are not those which are difficult to use with a continuous flow of material. Galvanic treatments at least normally mean loading in sets, whereas the treatments used in the present invention can be used with continuously moving material.

There is also the advantage that if the parts are given heat treatment in the form of a tempering process, before the pressure polishing process, a strength of about 10 to 20 kp/mm$^2$ above the normalizing strength is reached. In this condition, the pressure polishing process can be carried out particularly well, giving surface cold-hardening as well. As the material turns during the treatment the said cold-hardening builds up evenly over the surface. This also provides stresses acting in the lengthwise direction, which surprisingly keep the material completely straight. The speed of revolution during such pressure polishing as well as during the subsequent surface hardening is preferably within the range of approximately 500 to 1000 revolutions per minute.

A bar whose surface is pressure polished in this way has a very evenly polished surface which surprisingly is scarcely altered by the subsequent hardening process.

In one example of a process according to the invention, a cylindrical steel bar (which may be intended for use as a piston rod) is subjected in succession to a pressure polishing process and a surface hardening process whilst being rotated in any convenient manner at a speed of between 500–1000 rpm. The pressure polishing is affected by suitable rollers which can at the same time be used as feeding devices for the surface hardening process. As a result of the pressure polishing, the surface of the bar reaches a strength of about 110 kg/mm$^2$ and is held quite straight due to this strength. In the subsequent hardening process (the bar still being rotated) however, this strength reduces somewhat over the surface and adjacent layers during the heating which is necessary for the hardening, but immediately after the heating the strength increases again to about 60 to 64 Rc due to the quenching which is carried out. So during a continuous process according to the invention an outer zone of greater strength is created, such strength being first reduced and subsequently increased again. For the surface hardening process itself the known methods of inductive or conductive or fluid fuel burner heating can be used. It is however advantageous to subject the surface of the bar to gas treatment during such heating. This gas treatment can for example add carbon or nitrogen to the surface bar material. For piston rods it is advisable to add nitrogen at a temperature above the so-called $A_3$ temperature of the iron-carbon equilibrium diagram.

Although the process described above is applied to steel, a process according to the invention can be used with many metals which are hardenable and which are strengthened by pressure polishing. It is especially useful however for steels, as their heat conducting capacity favours the production of a hard surface layer. Thus, martensitic steel with 12% to 18% chromium and 0.4% to 0.6% carbon has proved to be particularly good for piston rods, if they are subjected to nitriding in the hardening process. Piston rods made in this way can be used directly, without further straightening, galvanic treatment or final polishing. The surface finish obtained also ensures particularly good resistance to corrosion.

I claim:

1. A process for manufacturing highly wear-resistant, undistorted, axially symmetrical elongated chromium-containing martensitic steel parts comprising the steps of: rotating the parts about their longitudinal axis at a speed of about 500 to 1000 revolutions per minute, subjecting the rotating part to a surface pressure polishing process to increase the strength to about 110 Kg/mm$^2$, and subjecting the polished rotating part to a surface hardening process which includes exposure to a surface-hardness-producing gas, selected from the group consisting of carbonizing and nitriding gas or mixtures thereof at a temperature above the $A_3$ temperature of the iron-carbon equilibrium diagram.

2. A process as set forth in claim 1 wherein said gas to which the parts are exposed during the case hardening process is a carbonizing gas.

3. A process as set forth in claim 1 wherein said gas to which the parts are exposed in said case hardening process comprises a nitriding gas.

4. A process for manufacturing highly wear-resistant, undistorted, axially symmetrical elongated martensitic steel parts containing 12% to 18% chromium and 0.4% to 0.6% carbon comprising the steps of: rotating the parts about their longitudinal axis at a speed of about 500 to 1000 revolutions per minute, subjecting the rotating part to a surface pressure polishing process to increase the strength, and subjecting the polished rotating part to a surface hardening process which includes exposure to a surface-hardness-producing gas so as to case harden the workpiece.

* * * * *